United States Patent [19]

Bubb

[11] 4,148,651

[45] Apr. 10, 1979

[54] INSTANT PROCESSING FILM UNIT HAVING INTERNAL DARK SLIDE

[75] Inventor: Wayne A. Bubb, Rochester, N.Y.

[73] Assignee: Eastman Kodak Company, Rochester, N.Y.

[21] Appl. No.: 834,589

[22] Filed: Sep. 19, 1977

[51] Int. Cl.[2] ..... G03C 1/48; G03D 9/02

[52] U.S. Cl. ..... 96/76 C; 354/304

[58] Field of Search ..... 96/76 R, 76 C, 67; 354/304

[56] References Cited

U.S. PATENT DOCUMENTS

| | | | |
|---|---|---|---|
| 406,085 | 7/1889 | Carlisle | 354/174 |
| 2,472,358 | 6/1949 | Wolff | 96/76 C |
| 2,740,714 | 6/1951 | Bachelder et al. | 96/76 C |
| 3,854,312 | 12/1974 | Sorli | 354/312 |
| 3,963,496 | 6/1976 | Arisaka | 96/76 C |

*Primary Examiner*—Richard L. Schilling
*Attorney, Agent, or Firm*—J. A. Matthews

[57] ABSTRACT

An instant-processing film unit of the preregistered, integral type includes an internal dark slide which protects the unit from exposure prior to use. The film unit includes a photosensitive element and a cover sheet between which the dark slide is removeably positioned to shield one side of the photosensitive element from light. Exposure from the other side is prevented by an opaque layer in the element itself. When used with an opaque processing composition, the unit can be handled in daylight, without fogging, both before and after exposure. The film unit is adapted for use in commercially available adapters for professional type cameras.

9 Claims, 15 Drawing Figures

INSTANT PROCESSING FILM UNIT HAVING INTERNAL DARK SLIDE

CROSS-REFERENCE TO RELATED APPLICATIONS

Reference is made to commonly assigned, copending U.S. patent applications Ser. No. 834,588 entitled INSTANT PROCESSING FILM UNIT WITH INTERNAL DARK SLIDE AND LIGHT SEAL, filed in the names of Charles J. Simpson and Richard H. Martens; Ser. No. 834,617 entitled INSTANT PROCESSING FILM UNIT, filed in the name of Robert A. Sylvester; and Ser. No. 834,590 entitled PHOTOGRAPHIC FILM UNIT, filed in the name of William H. Johnson, all on even date herewith.

BACKGROUND OF THE INVENTION

The present invention relates to photographic film units of the instant-processing type, and more specifically to such units which can be handled individually in daylight without fogging.

Previous instant-processing film units have taken a wide variety of forms, two of which are discussed below. One, frequently referred to as a 4×5 unit, because of the print dimensions produced by present commercial products, is depicted in U.S. Pat. No. 3,053,160, issued on Sept. 11, 1962. This first type also may be referred to as a post-registered, peel-apart film unit with reference to the initial and final positions of its respective elements. Another is depicted in U.S. Pat. No. 4,042,395, issued on Aug. 16, 1977 (application Ser. No. 572,541, entitled INTEGRAL FILM UNIT, and filed in the names of Frederick F. Tone et al. on Apr. 28, 1975.) This second type frequently is referred to as a pre-registered, integral film unit, again with reference to the positions of its elements.

Both of the above forms include a photosensitive element, a second sheet, and a pod containing processing composition. The photosensitive element has one or more layers of light-sensitive material for recording a latent image that is processable to establish a visible image. The second sheet is adapted to facilitate distribution of the processing composition over the photosensitive element for initiating such processing. It also may act as a support for the final visible image, but in some integral film units, such as the one described in the above-referenced application, the final image remains with the photosensitive element. In operation, the film units are moved through a processing device, such as a pair of pressure rollers, which ruptures the pod and distributes the composition in a layer of appropriate thickness between the photosensitive element and second sheet. The distributed composition then permeates the layers to process the latent image and establish the visible image.

In the 4×5 or post-registered, peel-apart type of film unit, the second sheet is separated from the photosensitive element to permit exposure of the element, then brought into registered relationship with the element for processing, and finally separated from the element to view the final print. The term "post-registered" identifies the feature requiring registration after exposure, while the term "peel-apart" refers to the removal of the second sheet from the photosensitive element in order to view the final print.

In the second or preregistered, integral type of film unit, the photosensitive element and second sheet are registered prior to exposure, preferably at the time of manufacture, and remain in substantially the same relative positions during and after exposure and processing. Ordinarily, the second sheet is transparent to permit exposure of the photosensitive element therethrough, and the element and sheet remain permanently attached to each other in the final print.

Further pertinent features of the abovementioned types of film units relate to their handling in daylight. The 4×5 unit is adapted to be handled individually in daylight both before and after exposure. This is facilitated by an opaque envelope which surrounds the photosensitive element and second sheet until the unit is loaded in appropriate exposing apparatus. Then the envelope is removed to permit exposure of the photosensitive element. After exposure, the envelope is returned to its original position which registers the second sheet over the element and again provides a light-tight environment. The envelope is removed after processing, and the second sheet is peeled-off, as described above, to reveal the final print.

Previous integral film units have not been designed for individual daylight handling prior to exposure. Instead, they are supplied in light-tight packs for loading into the corresponding apparatus. After exposure, however, the film units typically are ejected immediately from the camera, and processing is completed in daylight. This is permitted by providing an opaque layer in the photosensitive element on one side of the light-sensitive layers, and by adding an opacifier to the processing composition. When the opaque composition is distributed over the sensitive layers, it cooperates with the opaque layer to shield the sensitive layers from light. The final image then diffuses through one or the other of the opaque layers (the original layer or the distributed composition), where it is revealed for viewing.

Although previously known film units, such as those described above, apparently operate satisfactorily for their intended purpose, none offer the desired convenience for instant-processing film units that can be handled in daylight on an individual basis both before and after exposure. The 4×5 type described above requires rather complex manipulation of the opaque envelope. Moreover, even after removal of the envelope, the final print must be stripped from the photosensitive element. The film units are intricate in construction and difficult to manufacture, generate considerable waste in use, and require relatively complex utilizing apparatus which resists automation. While integral film units do not suffer from these problems, they have not been suitable for pre-exposure daylight handling on an individual or one-shot basis.

SUMMARY OF THE INVENTION

In accordance with the present invention, an instant-processing film unit is provided which is suitable for pre-exposure as well as post-exposure daylight handling on an individual or one-shot basis. The film unit is relatively simple in its physical construction, is easy to use and generates minimal waste compared to prior such film units. Although intended for use in presently available apparatus, the film unit is conducive either to simplified or more fully automated apparatus.

A preferred embodiment of the film unit includes a reservoir for processing composition, which composition preferably is opaque, a photosensitive element, and a second or cover sheet, with a dark slide removeably positioned between the element and sheet. The photosensitive element includes one or more lightsensitive layers, for recording a processable latent image, and opaque means, e.g., in the form of an opaque layer, opposite said sensitive layers from said cover for protecting said lightsensitive layers from exposure. The cover sheet is attached to the photosensitive element along the lateral margins of the element and sheet for facilitating the distribution of the processing composition therebetween. The dark slide, when in position between the sheets, cooperates with the opaque layer to shield the sensitive layers from actinic radiation.

While the preferred embodiment of the film unit is suitable for use in various types of apparatus, it has particular utility in presently available professional cameras. More specifically, the film unit is designed to be received in commercially available adapters for such cameras. When received in the camera, the dark projects from between the photosensitive element and cover sheet to a position accessible from the camera's exterior where the slide can be pulled from between the element and sheet to ready the photosensitive element for exposure. The film unit includes means for restraining the unit when the dark slide is removed and a leader extending from the film unit for facilitating removal of the unit from the camera after exposure and to initiate processing.

The film unit may further include a mask which establishes the final-print boundaries, wherein the dark slide is opaque throughout and beyond the bounded area, and especially where the mask is located internally between the photosensitive element and process sheet.

The preferred embodiment of the film unit includes all of the above features and the dark slide is made to extend beyond the leader in a manner making it natural in operating the camera to grasp the dark slide rather than the leader whenever the dark slide is present.

In the alternative embodiment, the dark slide is adapted for repositioning between the photosensitive element and cover sheet after exposure.

BRIEF DESCRIPTION OF THE DRAWINGS

In the detailed description of the preferred embodiment of the invention presented below, reference is made to the accompanying drawings in which.

DESCRIPTION OF THE ILLUSTRATED EMBODIMENTS

Figure 1:
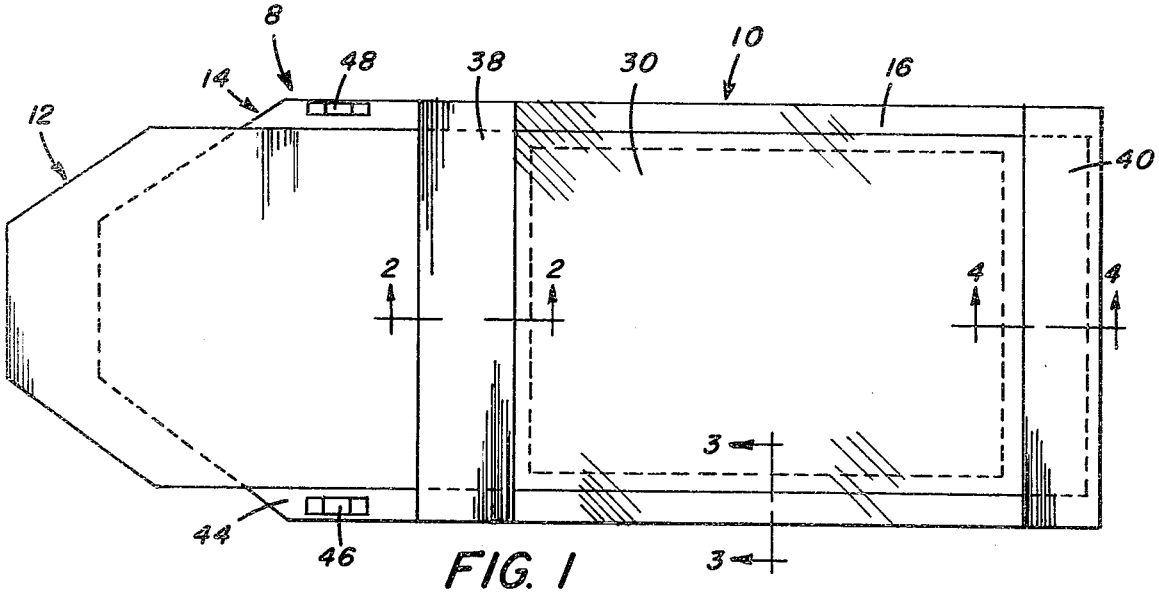
FIG. 1 is a plan view of a film unit in accordance with the preferred embodiment of the invention depicting its general features including the picture unit, dark slide, and leader.
Figure 2:
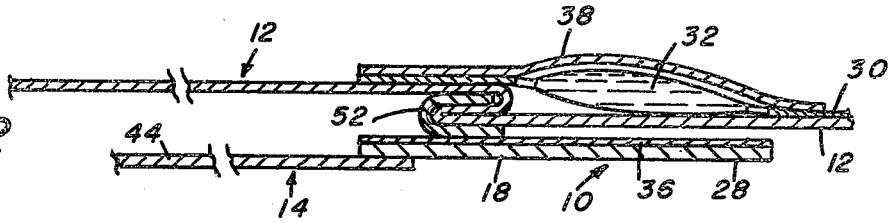
FIGS. 2–4 are cross-sectional views of the film unit of FIG. 1 taken as identified in FIG. 1 and illustrating internal features at the ends and edges of the film unit.
Figure 3:
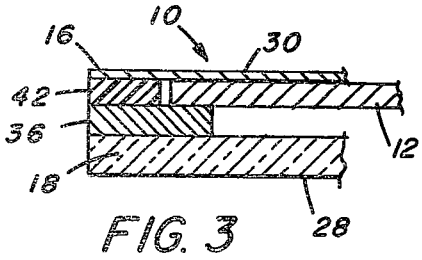
Figure 4:
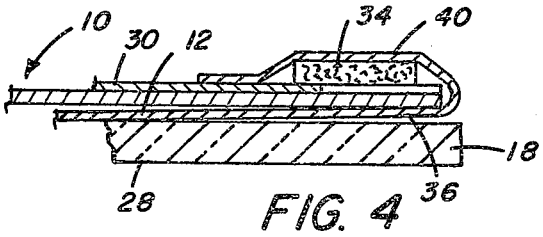
Figure 5:
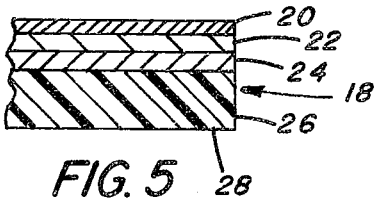
FIG. 5 is a cross-sectional view of the photosensitive element illustrating certain of its layers.
Figure 6:
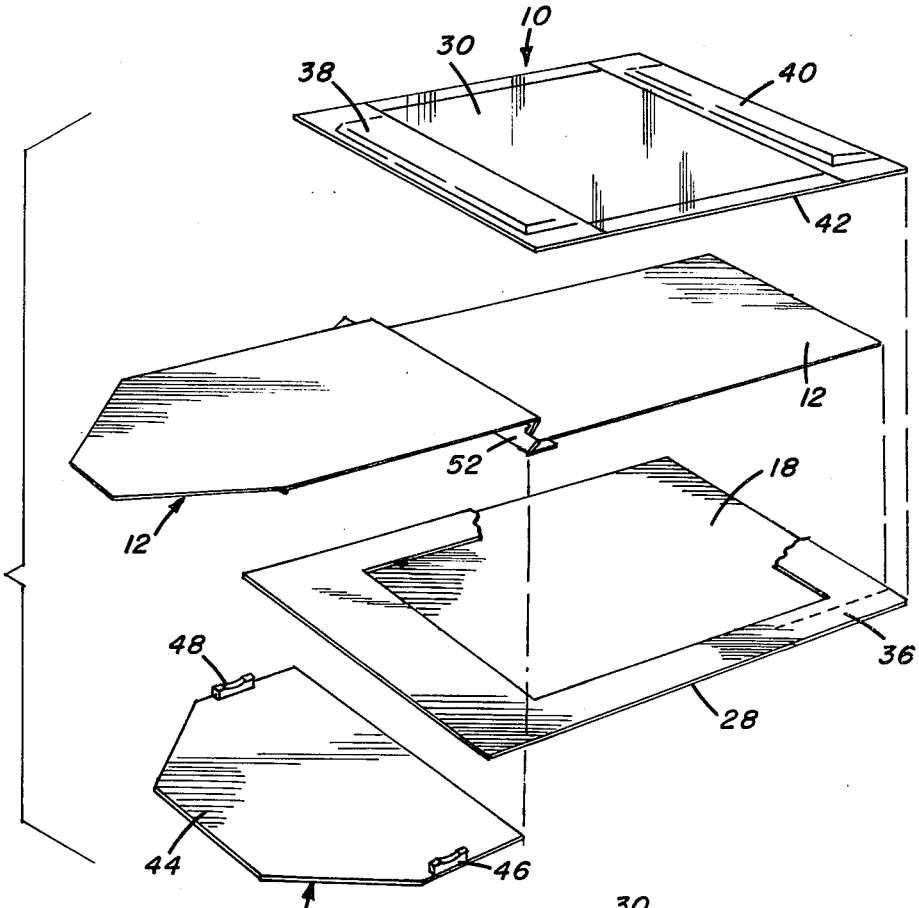
FIG. 6 is an exploded view of the film unit of FIG. 1.

Referring now to the drawings, and especially to FIGS. 1–6, a photographic film unit 8 is depicted in accordance with a preferred embodiment of the present invention as including a picture unit 10, dark slide 12 and leader arrangement 14.

The picture unit includes first and second sheets coupled along their lateral margins 16, as in the preregistered integral film unit described in the "Background of the Invention". One of the sheets is a photosensitive element 18 including a plurality of light-sensitive layers 20, (FIG. 5) an opaque layer 22 and an image receiving layer 24 carried on a dimensionally stable transparent support 26. These and additional respective layers of the photosensitive element are known in the prior art and will not be described in detail. It should be recognized, however, that the radiation sensitive layers are suitable for recording a latent image that is processable to establish a visibly perceivable image. The opaque layer shields the sensitive layers from actinic or other radiation striking one face 28 of the picture unit, and the image receiving layer is adapted to receive the final image, which diffuses thereto through the opaque layer during processing.

The other of the sheets is a transparent cover sheet 30 which serves several functions including confinement of the processing composition to facilitate its distribution during processing. As will become more apparent from the following description, the cover sheet also confines the dark slide in proper position for its intended purpose in accordance with the present invention.

Reservoir means, including a chemical pod or pouch 32 (FIG. 2) and trap 34 (FIG. 4) are disposed at the leading and trailing end sections of the picture unit, respectively. The pouch is provided for supplying the processing composition for distribution between the photosensitive element and process sheet. The trap collects any excess of the composition from between the element and sheet.

The final print when it is formed in the image receiving layer, should have precisely established edges. For this purpose, an opaque mask 36 extends along the end sections and lateral margins of the picture unit to create an image frame which defines the perimeter of the final picture area. Preferably, the mask is of the internal type adhered to the photosensitive element facing the cover sheet. The mask also may be used for covering the pod and trap, such as by cutting a piece 38 for placement over the pod and by folding another piece 40 around the trap and cover sheet. In such case, the mask helps block light from entering between the sheets at the leading and trailing ends of the picture unit.

On top of the mask, opaque side rails 42 (FIG. 3) of known caliper are provided for spacing the mask and cover sheet to receive the dark slide. It is through the side rails and the mask that the cover sheet is secured with appropriate adhesives to the photosensitive element. The combined mask and side rails also prevent light from entering between the sheets at the lateral margins of the picture unit.

The leader arrangement includes a flexible but somewhat stiff leader 44 overlapped with and attached to the leading end of the photosensitive element to facilitate handling of the film unit in cooperating apparatus as described more fully hereinafter. Saddle detents or shims 46 and 48 are provided at the lateral edges of the leader for similar purposes.

The internal dark slide 12 is positioned between the photosensitive element and cover sheet and cooperates with the opaque layer on the opposite side of the radiation sensitive layers to encase the sensitive layers and shield them from premature exposure. Thus, a single film unit can be handled in daylight without fogging. The dark slide has a length which is sufficient to extend from, beginning at the trailing end section of the picture unit, to beyond the leader where it will be natural to grasp the dark slide rather than the leader whenever the dark slide is present. The dark slide covers the entire image frame and extends therebeyond to overlap the mask around the entire perimeter of the final-image area. Moreover, the caliper of the dark slide is chosen so it will be confined and occupy the space between the mask and the cover sheet. It should not be so thick that its interference with the other elements causes undesirable frictional resistance nor so thin that it separates from the mask permitting light to reach and fog the photosensitive element.

Figure 7:
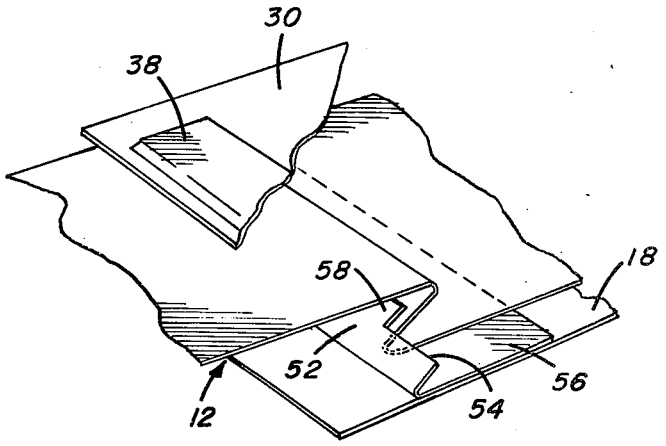
FIG. 7 is an enlarged partial view of a light seal between the dark slide and film unit at the leading end thereof.
Figure 8:
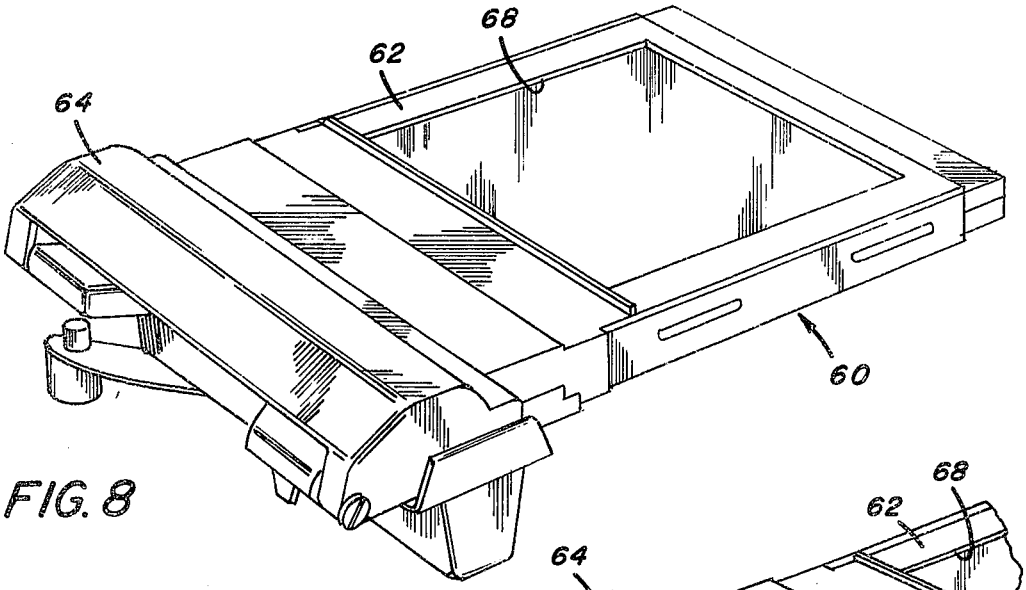
FIG. 8 is a perspective view of known apparatus in which the film unit of FIG. 1 is suitable for use.

At the leading end section of the picture unit, where the dark slide exits from between the sheets, additional light sealing means are provided in the form of an opaque flap or strip 52 having notches 54 (FIG. 7) at one end. The flap defines a body section 56, which is secured to the photosensitive element, and a tongue section 58. The tongue section and part of the body section are interleaved with and folded in the dark slide. Further details of this seal are described more fully in cross-referenced application Ser. No. 834,588, entitled INSTANT-PROCESSING FILM UNIT WITH INTERNAL DARK SLIDE AND LIGHT SEAL.

Figure 9:
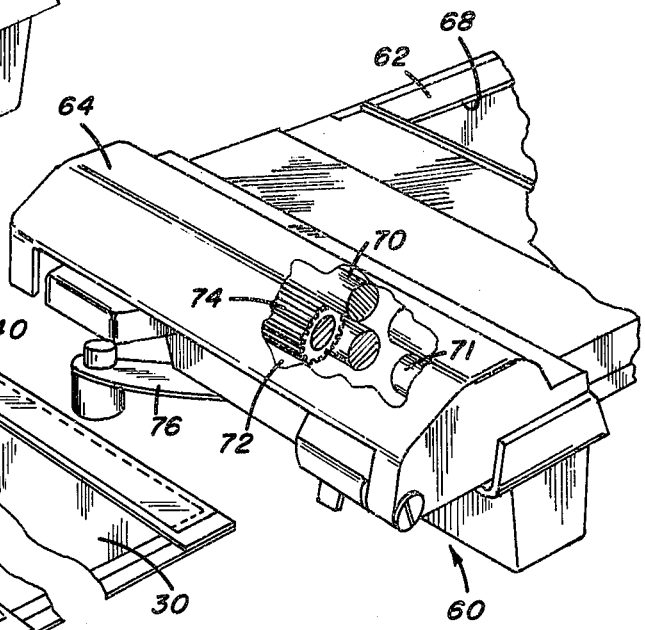
FIGS. 9–13 are partial perspective and front elevational views depicting the method of operation of the film unit of FIG. 1 in the apparatus of FIG. 8.
Figure 10:
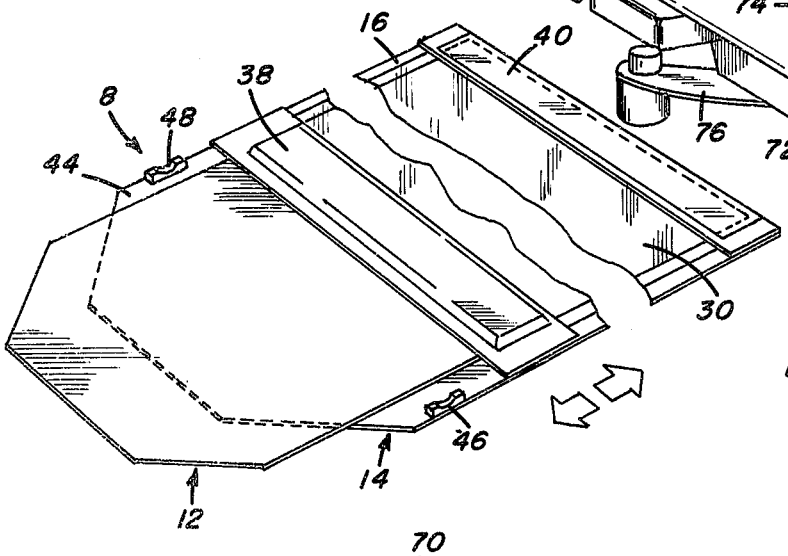
Figure 10:
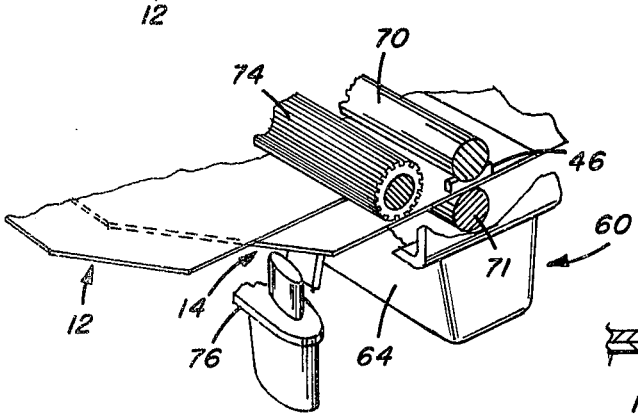
Figure 11:
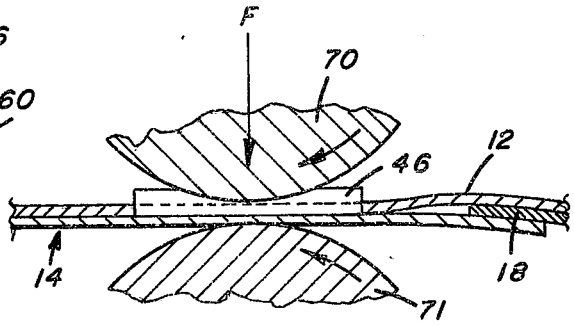
Figure 12:
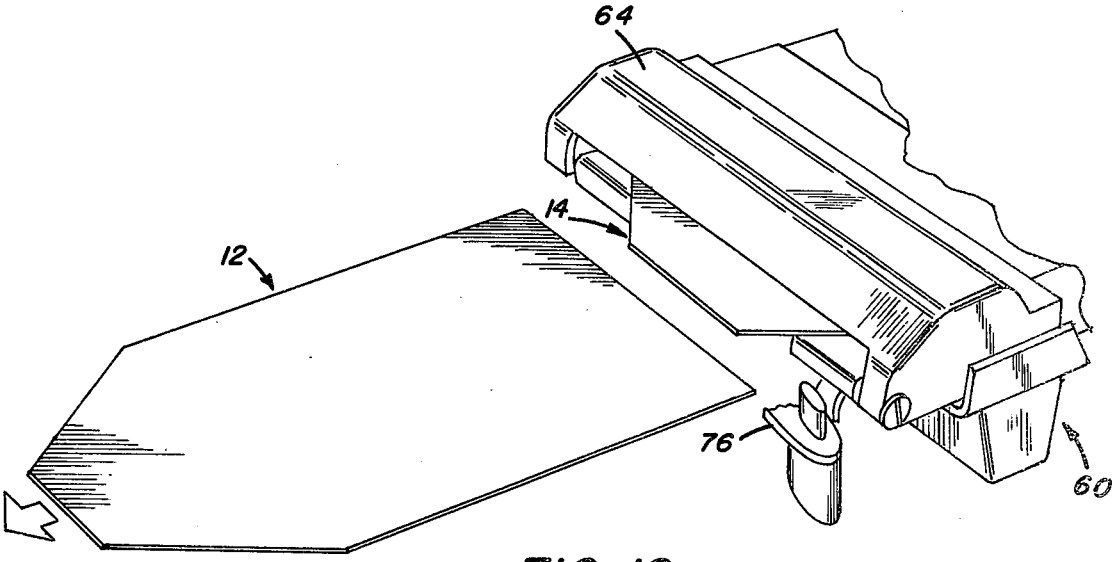

Referring now more specifically to FIGS. 8–13, the operation of the film unit is depicted with known apparatus. The apparatus comprises a camera-back adapter 60 of a type available commercially, including a body portion 62, and a processing section 64. The body portion defines a cavity for receiving individual ones of the film units and an exposure aperture 68 through which film units in the cavity are adapted to be exposed. The processing section includes a pair of pressure applying members 70, 71 (FIG. 9) and a passageway 72 which passes between light blocking means 74. A latch 76 partially shown in FIGS. 9 and 10 is moveable from an open or loading position (FIG. 9) where the pressure applying members are spaced-apart, and a closed or processing position (FIG. 10) where the members are urged together prior to initiating processing.

Figure 13:
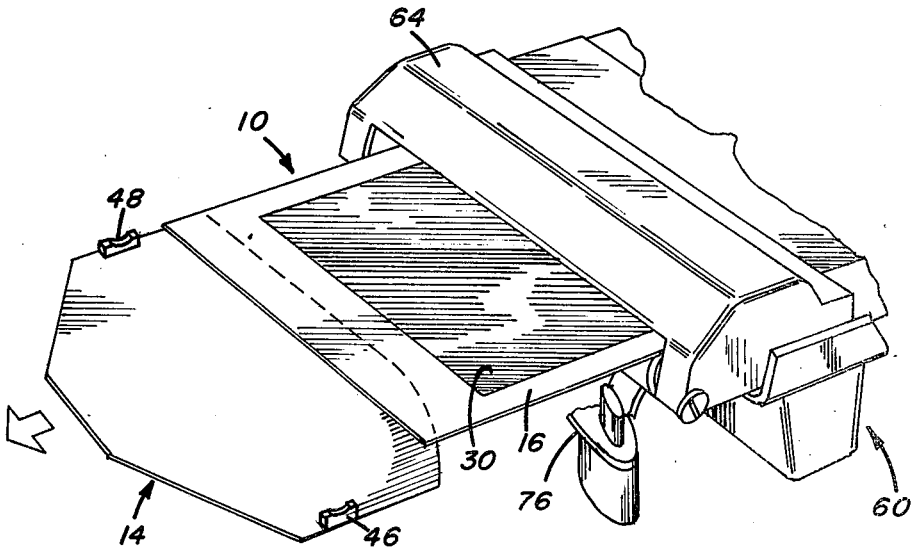

In operation, and referring first to FIG. 9, the latch 76 is moved to the open position, and the film unit is inserted through passageway 72 between the pressure applying members and into the cavity behind aperture 68. Suitable means, not shown, support the film unit in a substantially flat condition suitable for exposure. The latch 76 is closed and releases the pressure members which drop onto saddle detents 46 and 48 to hold the film unit in its proper operative position. The detents also may act as lifters to relieve some of the pressure of the members 70, 71 from the dark slide. The dark slide is then removed by grasping its leading end and pulling the slide (FIG. 12) entirely from the film unit and apparatus. This uncovers the photosensitive element and its light-sensitive layers for exposure. After exposure of the film unit, leader 44, uncovered by removal of the dark slide, is pulled to initiate processing and remove the film unit from the apparatus (FIG. 13). This distributes the processing composition from the pod between the photosensitive element and cover sheet. Assuming the composition includes an opacifier, as is common in integral film units, distribution of the composition establishes another opaque layer which cooperates with the first opaque layer 22 to shield the film unit from further exposure and permit daylight processing. During processing image-wise distributions of dyes diffuse through the first opaque layer 22, to the image-receiving layer 24, where the transferred image is visible from face 28 of the picture unit. Finally, if desired, the leader can be stripped from the picture unit which then becomes the final print.

Figure 14:
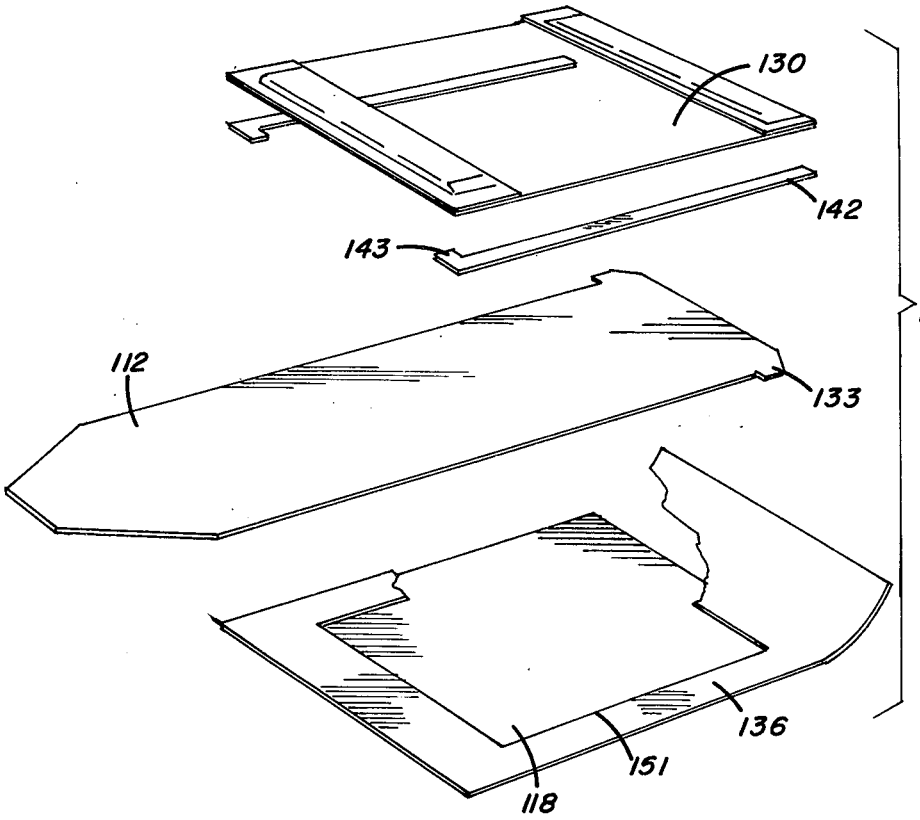
FIG. 14 is an exploded perspective view depicting an alternative embodiment of the invention.
Figure 15:
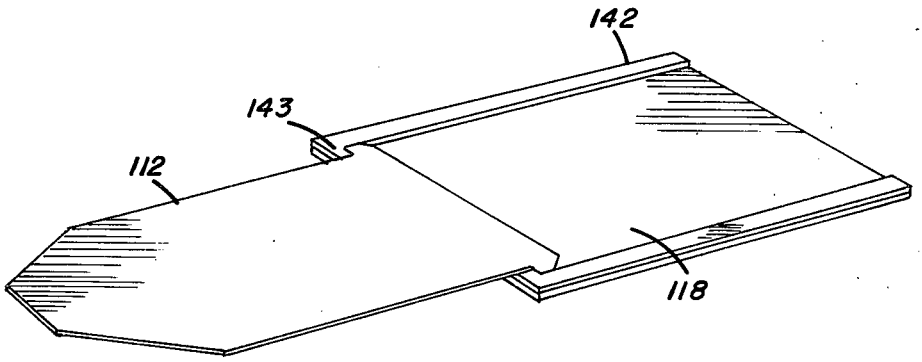
FIG. 15 is a perspective view of the alternative embodiment with the cover sheet removed and depicting the dark slide in a withdrawn position.

An alternative embodiment of the invention, depicted in FIGS. 14 and 15, includes a dark slide 112 that is adapted to be repositioned between the photosensitive element 118 and cover sheet 130 after exposure of the photosensitive element. In most respects, this alternative film unit is the same as the preferred embodiment, except the dark slide is notched or otherwise formed to define ears 133 at its trailing end, and the side rails 142 define abutments 143 at their leading ends. The ears on the slide and the abutments on the rails cooperate to arrest or restrain movement of the dark slide after it clears the image frame, defined by mask 136, but before it is removed beyond a suitable position aligned for reinsertion between the photosensitive element and cover sheet after exposure of the photosensitive element.

Thus, the dark slide is moveable between the photosensitive element and the cover sheet between a first position where it shields the photosensitive element from exposure through image frame 151 defined by mask 136 and a second position where it uncovers the photosensitive element for exposure through the frame.

It also may be desirable in this alternative embodiment to provide a thicker caliper material for the dark slide, to increase its rigidity or resistance, and to provide a corresponding increase in the caliper of the side rails, to accommodate the thicker dark slide. In such case, the mask can be used to establish the thickness of the distributed layer of processing composition, so the increased side rail caliper will not adversely affect the processing of the film unit.

It should now be apparent that the invention provides a number of significant advantages not available from the teaching of the prior art. Individual, instant processing film units can be handled conveniently in daylight both before and after exposure. The film units, much simpler in their physical construction than previously known units, are less likely to jam in use in cooperating apparatus. They require little mental concentration or physical dexterity in use and generate relatively little waste compared to prior approaches. Moreover, the units are conducive to use either in vastly simplified or automated apparatus which would not be sufficient for previously known units.

Still other advantages will become apparent to those skilled in the art from reading the above description.

Although the invention has been described with particular reference to a preferred embodiment thereof, it will be readily understood that variations and modifications can be effected within the spirit and scope of the invention as described hereinabove and as defined in the appended claims.

I claim:

1. An instant-print film unit for recording a latent image processable by a liquid composition to establish a visibly perceivable image, said film unit comprising:

means for supplying the liquid composition;

a photosensitive element having first and second faces and including at least one light-sensitive layer therebetween for recording the latent image;

an opaque layer for shielding said light-sensitive layer from fogging through said second face;

a transparent cover sheet coupled over the first face of said photosensitive element along the lateral margins of said element, said cover sheet facilitating distribution of the processing composition between said element and sheet; and a dark slide removably positioned between said photosensitive element and said cover sheet, said dark slide shielding said light-sensitive layer from fogging through said first face.

2. A preregistered, instant-processing film unit comprising:

a picture-recording unit including a photosensitive element, a transparent cover sheet and means containing a distributable processing composition; said photosensitive element having at least one photosensitive layer for recording a latent image processable by the composition, and an opaque layer located on one side of said photosensitive layer; said cover sheet being coupled to and cooperative with said photosensitive element for distributing a processing composition between the element and sheet; said processing composition including an opacifier which, when distributed between the element and sheet, cooperates with said opaque layer to protect said photosensitive layer from fogging in daylight; and a dark slide positioned between said photosensitive element and said cover sheet for cooperating with said opaque layer to protect said photosensitive layer from fogging in daylight, said dark slide being removable from said position prior to distributing said processing composition to permit the recording of the latent image in said photosensitive layer.

3. An instant-processing film unit including reservoir means for supplying a processing composition, said film unit comprising:

a photosensitive element having a first face through which it is adapted to be exposed to an image, and a second opposite face, said element including opaque means for protecting said element from daylight exposure through said second face;

a transparent cover sheet coupled over the first face of said photosensitive element to the lateral margins thereof for distributing the processing composition between said element and said sheet;

an opaque mask secured to said photosensitive element and said cover sheet and defining a frame through which the first face of said photosensitive element is adapted to be exposed; and a removable dark slide between said photosensitive element and said cover sheet to shield the first face of said photosensitive element from exposure through said frame.

4. An instant-processing film unit including reservoir means for supplying an opaque, spreadable processing composition, said film unit comprising:

a photosensitive element having first and second faces, leading and trailing end sections, and lateral margins, said photosensitive element including an exposable light-sensitive layer between said faces for recording images and means for shielding said sensitive layer from exposure through the second face;

a transparent cover sheet superposed over the first face of said photosensitive element and attached to the lateral margins thereof for aiding in spreading the opaque processing composition over the first face to initiate processing of images recorded in said sensitive layer, said opaque composition, when spread over the first face, shielding said sensitive layer from exposure through the first face; and a flexible dark slide between said photosensitive element and said cover sheet, said dark slide shielding said sensitive layer from light exposure through the first face, said dark slide extending from between said element and sheet at the leading end section for removing said dark slide from said shielding position and thereby permitting exposure of said sensitive layer prior to spreading the opaque composition.

5. A photographic film unit including reservoir means for supplying processing composition; said film unit comprising:

first and second sheets having opposed lateral margins, one of said sheets including a photosensitive element having first and second faces, the other of said sheets being transparent;

a mask element connecting said first and second sheets together along their lateral margins and defining an exposure frame through which the first face of said photosensitive element is adapted to be exposed;

an opaque layer in said photosensitive element for shielding said photosensitive element from exposure through the second face; and a dark slide opaque to daylight and removably positioned between the sheets, said dark slide, when in said position, shielding said photosensitive element from exposure through said frame.

6. A preregistered, instant-print film unit comprising:

first and second sheets each defining opposed lateral margins, one of said sheets including a photosensitive element for recording images and an opaque layer for protecting said photosensitive element from exposure through one side of said one sheet, the other of said sheets being transparent;

reservoir means for storing a processing composition and coupled to said sheets for introducing the composition between the sheets;

a masking element opposite said photosensitive element from the opaque layer and attaching said first and second sheets together along their opposed lateral margins, said masking element including means for establishing a predetermined thickness of the processing composition between the sheets and defining an exposure frame through which said photosensitive element is adapted to the exposed; and a dark slide opaque to actinic light and removably positioned between the sheets, said dark slide shielding said photosensitive element from exposure through said frame.

7. A flexible, photographic film unit for use in exposure apparatus; said film unit comprising:

first and second sheets having opposed lateral margins, one of said sheets including photosensitive means for recording latent images, the other of said sheets being transparent;

a pouch for supplying processing composition for distribution between said first and second sheets;

a mask between said first and second sheets connecting said sheets together along their lateral margins and defining an exposure frame through which said photosensitive means is adapted to be exposed;

an opaque layer in said one sheet, said photosensitive means being disposed between said opaque layer and said mask to shield said photosensitive means from exposure other than through the exposure frame;

a leader extending from one of said sheets for facilitating the removal of said film unit from the exposure apparatus; and a dark slide opaque to daylight and removably positioned between said sheets to shield said photosensitive means from exposure through said frame.

8. A instant-processing film unit including reservoir means for supplying a processing composition, said film unit comprising:

a photosensitive element having a first face through which it is adapted to be exposed and a second opposite face, said photosensitive element including image-recording means and opaque means for protecting said image-recording means from exposure through the second face;

a transparent cover sheet superposed over the first face of said photosensitive element for distributing the processing composition between said element and said sheet;

an opaque mask secured to said photosensitive element and said cover sheet between the marginal edges of said element and sheet and defining a frame through which the image-recording means is adapted to be exposed; and a dark slide positioned between said photosensitive element and said cover sheet, said dark slide being moveable from a first position shielding the image-recording means from exposure through the frame, to a second position permitting exposure of said image-recording means through said frame.

9. A photographic film unit comprising:

first and second sheets having opposed lateral margins, one of said sheets having first and second faces and including a photosensitive element for recording images, the other of said sheets being transparent;

means for containing a processing composition distributable between said sheets to process the recorded images;

a mask element connecting said first and second sheets together along their lateral margins and defining a frame through which the first face of said photosensitive element is adapted to be exposed;

an opaque layer in said one sheet for shielding said photosensitive element from exposure through the second face of said one sheet; and a dark slide opaque to daylight and positioned between said sheets for sliding movement between first and second positions, said dark slide in said first position covering said photosensitive element to shield said photosensitive element from exposure through said frame and in said second position uncovering said photosensitive element for exposure through said frame.

* * * * *